United States Patent [19]

Kim

[11] Patent Number: 4,804,323

[45] Date of Patent: Feb. 14, 1989

[54] MUSIC CANDLE

[76] Inventor: Kyung-Hee Kim, 10-tong, 3-ban, 41-4, Songpa-dong, Kangdong-ku, Seoul, Rep. of Korea

[21] Appl. No.: 932,168

[22] Filed: Nov. 18, 1986

[30] Foreign Application Priority Data

Nov. 18, 1985 [KR] Rep. of Korea ..... 85-15119

[51] Int. Cl.[4] ..... F23D 3/02; G10H 1/18; G10H 1/32

[52] U.S. Cl. ..... 431/253; 84/1.01; 84/1.18; 250/227; 350/96.10; 362/810

[58] Field of Search ..... 431/288, 253, 289; 250/215, 216, 211 R, 227; 84/1.01, 1.18, DIG. 8, DIG. 19; 350/96.17, 96.20, 96.15, 96.10; 362/32, 810

[56] References Cited

U.S. PATENT DOCUMENTS

| | | | |
|---|---|---|---|
| 3,762,857 | 10/1973 | Andeweg | 431/289 |
| 4,477,249 | 10/1984 | Ruzek et al. | 431/289 |
| 4,516,827 | 5/1985 | Lance | 350/96.15 |
| 4,568,269 | 2/1986 | Lin | 84/2 |

*Primary Examiner*—Stanley J. Witkowski
*Attorney, Agent, or Firm*—Ladas & Parry

[57] ABSTRACT

A melody producing candle in which an Integrated Circuit (IC) placed within the candle is activated upon kindling of the wick to produce music. The candle stops playing music once the flame is put out. The invention is provided with a light reflector which allows adjustment of sensitivity of the candle to light.

9 Claims, 3 Drawing Sheets

MUSIC CANDLE

FIELD OF THE INVENTION

This invention relates to candles and musical devices and, in particular, to a candle containing an Integrated Circuit capable of producing a musical sound when the wick of the candle is kindled.

BACKGROUND OF THE INVENTION

There exists music playing candles, like those the present Applicant has made applications for Utility Model registrations in South Korea under Application Nos. 85-232, 85-724 and 85-725 as shown in FIG. 1. However, these candles are able only to sense either the heat or the light of the wick flame and therefore have disadvantages. For example, for the type of music playing candle that senses heat only, a heat sensor like a thermister is likely to delay the action of the IC that causes the melody to be generated until the sensor is heated to a certain temperature and, when snuffing the flame, does not instantly interrupt the melody playing until the sensor is cooled down to a certain temperature. The disadvantage is that in both lighting and snuffing the flame the candle is slow to react.

Still another disadvantage, in a different type of heat sensor used in known musical candles, is that the heat sensor is arranged to be in close exposure to the flame so that the copper line connecting the sensor to the IC element is likely to be cut off as the candle melts.

In the type of light sensor used is known musical candles, the sensor within the candle is made to responde to light delivered by means of an optical fiber or through the translucent wall of the candle. However, this type of sensor also has the disadvantagee of responding to light from sources (e.g. such as sunshine or a floodlight) other than the wick flame of the candle and thereby causes accidental activation of the music. This drawback makes it difficult to control the music response under outdoor sun rays or strong lighting.

In use, the light-only sensor often responds even to a match light approaching to kindle the wick. Accordingly, in the case, for example, of a birthday party where the well-wishers waiting to sing "Happy Birthday to You" upon kindling candles, those present may experience an awkward situation following an ill-timed playing of music.

Further, in production of melody candles employing the light-only sensor, the construction of combining an optical fiber and a light sensor element (as in the construction of the above noted applications for utility model registration) can not control quality or sensitivity of the candle because of the high sensitivity of the sensor.

SUMMARY OF THE INVENTION

The present invention is devised to eliminate the aforementioned defects of conventional melody candles. The present invention avoids the unintentional activation of music playing or ill-timed (i.e. early) response of the sensor which is a disadvantage of the melody candle employing a light sensor, particularly a light sensor using a known optical fiber. According to the present invention, upon kindling the wick, an Integrated Circuit (IC) placed within the candle is activated and produces music and upon snuffing of the candle stops playing music. Furthermore, by providing a light reflector having changable colors, the present invention prevents accidental or unintentional activation of the IC by having the ability to adjust the heat and light sensitivity of the device.

BRIEF DESCRIPTION OF THE DRAWINGS

The invention will be more fully understood from the following description of a preferred embodiment of a music candle as shown in the accompanying drawings wherein

FIGS. 2(*b*) and (*c*) respectively showing the states of the apex of FIG. 2(*a*) before and after being split by the heat of the kindled wick flame to provide light beam inlets of the optical fiber element;

FIG. 4(*d*) showing the opaque material capping of the optical fiber end being melted to expose the light inlet of the element;

Figure 1:
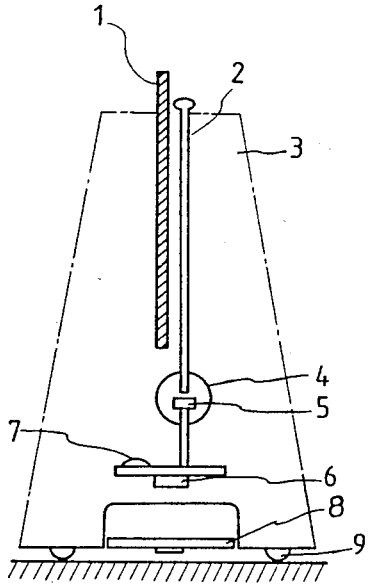
FIG. 1 shows a vertical section of a conventional melody producing candle (for which Utility Model registrations, under Application Nos. 85-232, 85-724 and 85-725 are pending)

Element numerals in the drawings are, in part, as follows: Numeral 1 indicates the wick of candle; 2' indicates the optical fiber element; 4 a black box; 10' is a meltable cap; 14 a reflector plate.

DETAILED DESCRIPTION OF THE INVENTION

Figure 2A:
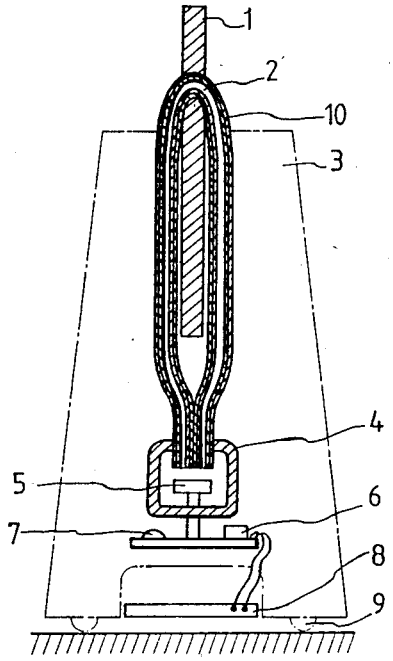
FIG. 2(*a*) shows an optical fiber element whose apex is shaped in the form of an inverted "U"
Figure 2B:
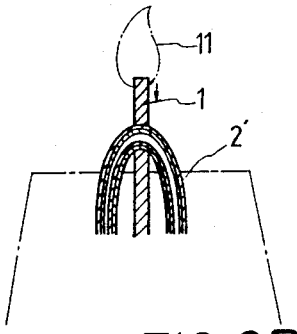
Figure 2C:
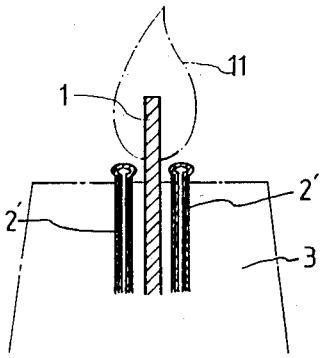
Figure 3A:
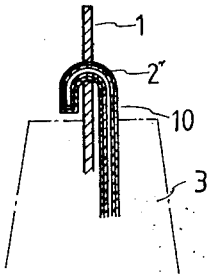
FIG. 3(*a*), 3(*b*) (*c*) show the partical coatings of an opaque material for the exposed apex end of the FIG. 3(*a*), and FIG. 3(*d*) shows the FIG. 3(*a*) apex end being melted off by the heat of the wick flame and providing a light beam inlet for the optical fiber element.
Figure 3B:
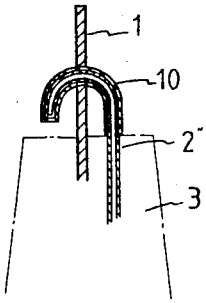
Figure 3C:
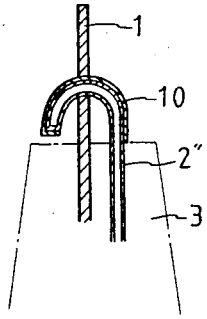
Figure 3D:
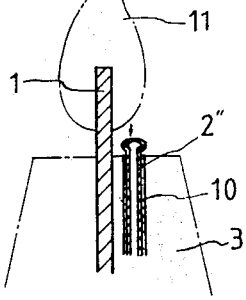
Figure 4A:
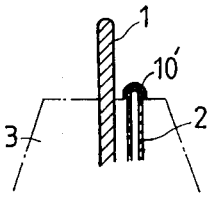
FIGS. 4(*a*), (*b*) and (*c*) show opaque material cover cappings for the upright end light inlet of the optical fiber element.
Figure 4B:
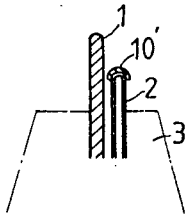
Figure 4C:
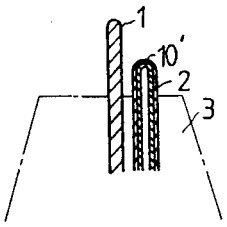
Figure 4D:
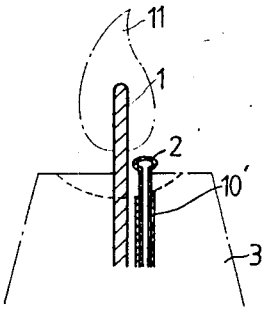

An optical fiber strand 2', the surface of which is coated with an opaque material, is folded in two halves as in FIG. 2(*a*) and is positioned so that the apex of an inverted U-shaped optical fiber strand 2' is placed close to the wick end for kindling. The ends at the opposite side of the apex of the strand 2' face a known light sensor element 5 such as CDS or photo TR, which is sealingly encased along with the strand ends in a casing 4 to be cut off from exterior light. Upon kindling as in FIG. 2(b), the wick 1 with its flame 11 burns itself downward and melts a portion of the strand which splits the optical fiber strand 2' to produce two light inlets of two optical fiber strands as shown in FIG. 2(*c*).

According to the present invention, since the optical fiber strand 2' has no light inlets unless it is cut into two by the wick flame to provide such, no light ray, no matter however strong it is applied thereto, can cause an accidental or inadvertent activation of music play. Only when the kindled wick 1 with its flame burns itself downward and melts the optical fiber to break it into two will the music be produced. Therefore, the possibility of responding to any other light, such as a match light, before the melt-breaking of the strand 2', is completely eliminated. Upon kindling the wick 1, two light inlets are formed as shown in FIG. 2(*c*) so that the two can provide a better, stable range of fluctuation of light applied to the sensor than one strand with one inlet, even as the wick declines or at flickering of the wick flame.

The opaque coating material 10 of the optical fiber 2' may be a parafin mixed with an opaque coloring matter or a metal of low melting point. The purpose of coating is to prevent conduction of light, like strong sun rays, through the surface of the fiber or at the apex of the inverted U-shaped fiber. The coating may, as required, be partially made only on the apex portion exposed to the exterior.

In an alternate embodiment of the invention, a strand of optical fiber 2" partially is or totally coated on its surface by an opaque parafin or a metal of low melting point, and one of its ends is bent in an inverted hook-shaped form (i.e. an inverted "J") to make the section at the end face downward and is placed, as shown in FIGS. 3(*a*), (*b*) and (*c*), near the wick end for kindling with the entire strand being parallel to the wick flame. Upon kindling of the wick, as in the other embodiment, the wick flame, coming down with the burned wick end, melts the bent end portion to break it off from the main strand of the optical fiber and provides a light inlet as in FIG. 3(*d*). Through this inlet, the light of the flame 11 is conducted to make the sensor element 5 respond to activate an IC (not shown) for music playing.

This embodiment is the same in characteristics as in the previous embodiment, except that the previously discussed embodiment is to have two light inlets. Accordingly, this embodiment too has the characteristic of preventing a wrong or early activation of the IC. The opaque material coating may be made only for the portion exposed to the exterior, as in FIG. 3(*b*) and (*c*).

Still another embodiment within the scope of the invention shown in FIGS. 4(*a*) through 4(*d*) differs from the preceding embodiments in that a light inlet of the optical fiber strand 2' is already formed but capped by an opaque material of low melting point. While in the previously discussed embodiments the optical fiber 2' is melt-cut by heat of the wick flame to provide a newly formed cross sectional face(s) for light inlet, the present embodiment merely has a cap 10' covering the already formed light inlet as shown in FIGS. 4(*a*) through 4(*c*) to be melted away by the wick flame to expose the inlet after melt-removing the cap as shown in FIG. 4(*d*). The purpose and effect of this embodiment is the same as with the preceding embodiments.

Figure 5A:
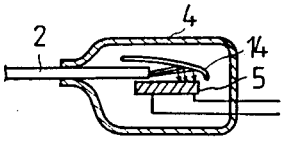
FIGS. 5(*a*) and (*b*) show combination constructions of an optical fiber element and a light sensor element in the invention which are adjustable for light sensitivity.
Figure 5B:
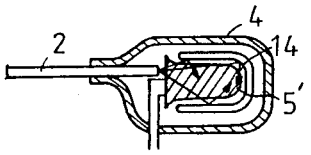

Another advantage of this invention is its combined structure of an optical fiber 2 and a light sensor elements 5 that makes possible the adjustment of sensitivity. As shown in FIG. 5(*a*), a part of light coming out of the optical fiber 2 after conduction through it is directly applied to the sensor 5 but most of the light goes first to a reflector 14 to be reflected from there toward the sensor 5.

Therefore, for weakening the sensitivity, the light reflector14 may be made of a dark surface for weak reflection, and for stronger sensitivity the reflector surface be made of a bright color (e.g. white color for best reflection).

When the reflector 14 is made of a flame color, the sensor becomes more sensitive to the wick flame, while showing a weak sensitivity to the lights from other sources. That is, light rays in other than the flame color are absorbed by the reflector 14 leaving only the ray corresponding to the wave length of the wick flame color for reflection to the sensor. The light ray from the wick flame is the same in color with that of the reflector 14 so that most of the ray reflects at the reflector toward the sensor to make it more sensitive.

Further, as shown in FIG. 5(*b*), a sensor 5' that is moulded with a color filtering material to intercept all rays other than the infra red ray for passing on may greatly improve the effect of it and provide a better quality product.

I claim:

1. A musical candle comprising:

electronic circuit means housed within a candle for playing music upon activation by lighting a wick of said candle;

an optical fiber strand of synthetic resin being disposed in said candle adjacent an exposed end of said wick and being folded upon itself to block exterior light from extering said fiber reflector means provided at a distal end of said optical fiber for concentrating light from said strand onto light sensor means in said electronic circuit means, whereby heat from lighting said wick melts said folded optical fiber to permit light from said lighted wick of said candle to activate said electronic circuit means to play music.

2. The musical candle of claim 1 wherein said optical fiber takes the form of an inverted "U", both sides of said "U" shaped fiber conducting light to said reflector means.

3. The musical candle of claim 1 wherein said optical fiber takes the form of an inverted "J", a longer side of said "J" conducting light to said reflector means and a shorter side of said "J" being disposed in said candle.

4. A musical candle of claim 1 wherein said optical fiber is covered with an opaque material.

5. A musical candle of claim 4 wherein said opaque material is a low melting point metal.

6. A musical candle of claim 1 wherein said light sensor means includes a phototransistor, and light is emitted from said optical fiber towards a rear side of said phototransistor.

7. A musical candle comprising:

electronic circuit means housed within a candle for playing music upon activation by lighting a wick of said candle;

an optical fiber strands of synthetic resin being disposed in said candle adjacent an exposed end of said wick, an exposed end of said fiber being convered by an opaque cap having a low melting point to block exterior light from entering said fiber;

reflector means provided at a distal end of said optical fiber for concentrating light from said strand onto light sensor means in said electronic circuit means, whereby heat from lighting said wick melts said cap to permit light from said lighted wick of said candle to activate said electronic circuit means to play music.

8. A musical candle of claim 7 wherein said cap is formed of a low melting point metal.

9. A musical candle of claim 7 wherein said light sensor means includes a phototransistor, and light is emitted from said optical fiber towards a rear side of said phototransistor.

* * * * *